US005924704A

United States Patent [19]

Johnson

[11] Patent Number: 5,924,704

[45] Date of Patent: Jul. 20, 1999

[54] FOOT SUPPORTING ROLLING DEVICE

[75] Inventor: Lennart B. Johnson, Milford, N.H.

[73] Assignee: Jenex, Inc., Milford, N.H.

[21] Appl. No.: 08/582,184

[22] Filed: Jan. 2, 1996

[51] Int. Cl.[6] ..... A63C 17/14

[52] U.S. Cl. ..... 280/11.2; 280/11.22

[58] Field of Search ..... 280/11.19, 11.2, 280/11.22, 11.23, 87.041, 87.042

[56] References Cited

U.S. PATENT DOCUMENTS

| | | |
|---|---|---|
| 606,496 | 6/1898 | Allen . |
| 650,228 | 5/1900 | Cattaneo . |
| 926,646 | 6/1909 | Eubank, Jr. . |
| 1,501,589 | 7/1924 | Ferris . |
| 3,156,324 | 11/1964 | Colbert . |
| 4,312,514 | 1/1982 | Horowitz et al. . |
| 4,526,389 | 7/1985 | Chase . |
| 4,987,978 | 1/1991 | Jungersen . |
| 5,183,275 | 2/1993 | Hoskin . |
| 5,375,070 | 12/1994 | Pelligrini, Jr. et al. . |
| 5,411,276 | 5/1995 | Moldenhauer . |
| 5,511,805 | 4/1996 | McGrath . |
| 5,575,489 | 11/1996 | Ogen et al. ..... 280/11.28 |

FOREIGN PATENT DOCUMENTS

| | | |
|---|---|---|
| 22575 | 4/1987 | United Kingdom . |

*Primary Examiner*—Richard M. Camby
*Attorney, Agent, or Firm*—Fish & Richardson P.C.

[57] ABSTRACT

A foot supporting rolling device including a foot supporting structure for supporting a users foot, first and second wheels rotatably mounted on said foot supporting structure, said first and second wheel being made of an elastomeric material of a first hardness and a roller mounted in such fashion that it can be forced against both first and second wheels so as to provide resistance to the rotation of the first and second wheels.

33 Claims, 7 Drawing Sheets

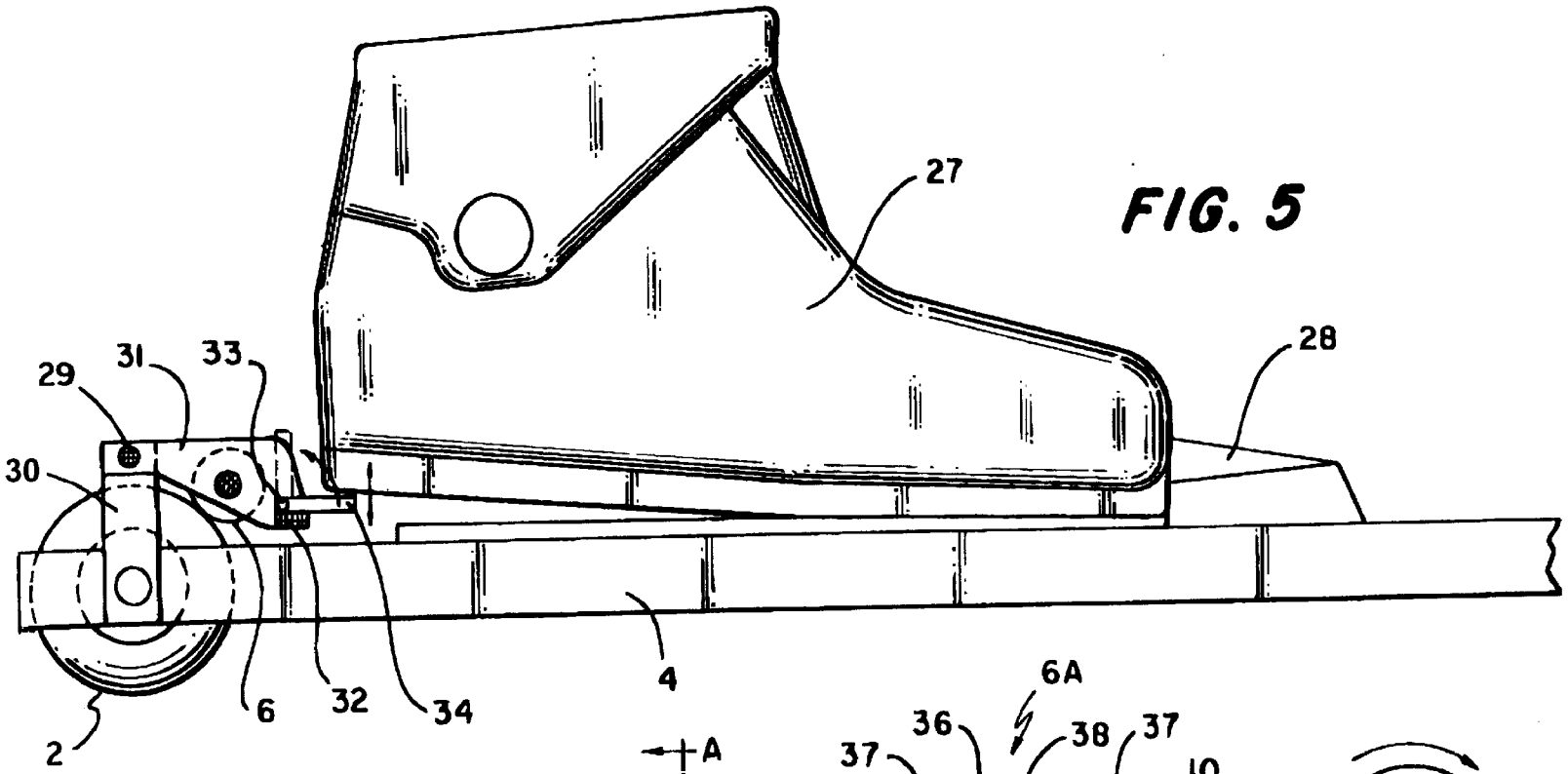
FIG. 5
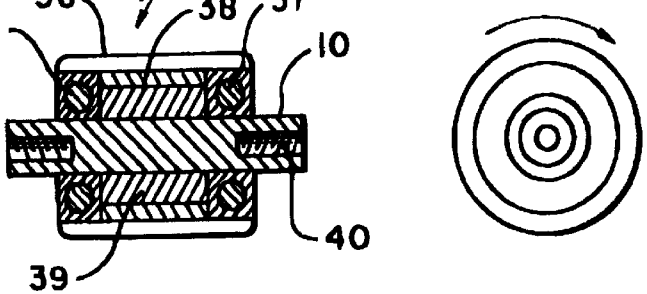
FIG. 6B
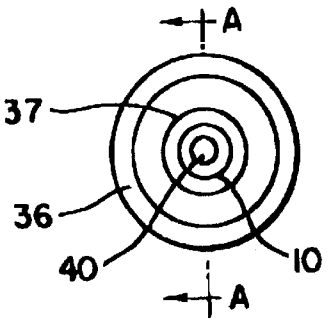
FIG. 6A
FIG. 6C

FOOT SUPPORTING ROLLING DEVICE

BACKGROUND OF THE INVENTION

The invention relates to foot supporting rolling devices such as in-line skates and roller skis.

In-line skates have small narrow wheels positioned one after the other, i.e., in-line, and are used for both recreation and for general aerobic conditioning. Roller skis generally have two wheels and are mainly used for training by competitive cross-country and Alpine skiers in the non-snow seasons.

In-line skates can have brake mechanisms that typically frictionally engage either a wheel or the rolling surface, e.g., the road surface. In one type of brake mechanism, a skater's foot is moved forward to cause brake activation by pivoting of an upper cuff of the skate shell. In-line skates can also be provided with slower or faster wheels to adjust rolling resistance, i.e., the natural rolling resistance of the in-line skate when not being decelerated by a frictional brake.

U.S. Pat. No. 5,374,071 describes a speed reducing device that employs a roller that is forced against a wheel of an in-line skate or roller ski with an adjustable force to provide different amounts of rolling resistance.

SUMMARY OF INVENTION

In one aspect, the invention features in general a foot supporting rolling device (e.g., an in-line skate or roller ski) that employs a roller that can be forced by the user against two wheels at the same time. This causes a speed reduction action to be applied to two wheels, providing for more consistent braking or rolling resistance than with only one wheel, which might only intermittently touch the ground, owing to close spacing between wheels and uneven road surfaces.

In another aspect, the invention features in general a foot supporting rolling device in which a roller is forced against a wheel that is movable, up and down, in a perpendicular direction to the road surface and is biased toward the road surface in such fashion that the wheel follows the contour of the road surface and is in continuous contact with the road surface.

In both aspects of the invention, the roller, through the application of variable force, provides a variable resistance to the forward rotation of the wheel or wheels. When the roller is fully engaged, it can provide sufficient resistance to gradually stop the in-line skate or roller ski on even a relatively steep downhill. Since the roller assembly does not work by normal friction, as when a brake pad is forced against the pavement, there is minimal wear of either the wheel or the roller assembly.

The variable speed reducing device has numerous other advantages for both novices and seasoned in-line skaters. With the speed reducer slightly engaged the user can benefit from higher rolling resistance, thus getting a more beneficial aerobic workout.

In another aspect of the invention, the invention features a foot supporting rolling device in which the backward rolling resistance is substantially increased over the forward rolling resistance. This permits novice in-line skaters to travel forward with low resistance while being able to push backward with minimal slippage. In one embodiment, the differential resistance is provided by a uni-directional locking mechanism. In another, the surface of the roller is such (e.g., like a ratchet) that there is more resistance in the backward direction than the forward.

For additional rolling resistance, the roller can be constructed with kinematic damping, thus producing increased rolling resistance without additional displacement of the elastomeric material. When the roller is engaged by a hand operated cam actuating device it acts as a gear box in an automobile and with the speed reducer engaged there is sufficient rolling resistance to make conventional in-line brakes work much more effectively.

In one embodiment the back (heel) portion of the boot structure is movable, up and down, so that when the skater is pushing off for forward motion and more weight is placed on the push off foot there is more pressure at the rear of the boot forcing a movable uni-directional roller assembly against one spring loaded wheel or against two wheels. The skater can place more weight and pressure at the rear of the boot by leaning slightly backwards forcing the movable roller assembly against the wheels with greater force, which shift in weight increases rolling resistance and causes the skates to gradually slow down. With simple variation in heel pressure the user can maintain speed, increase speed or stop.

In a preferred embodiment the roller assembly consists of a cylindrical roller housing with an outside diameter from 10 mm to 40 mm, the preferred diameter being 25 mm. In one preferred embodiment the roller housing contains two ball bearings, a clutch assembly, a spindle and an axle which is connected in such a fashion as to prevent slippage of the uni-directional device under frictional load. However, there are other low-friction, one-way rotational locking devices which could also be used to accomplish the same function.

Other advantages and features of the invention will be apparent from the following description of the preferred embodiments thereof and from the claims.

BRIEF DESCRIPTION OF THE DRAWINGS

FIG. 5 is a side view of a roller ski with a foot actuated roller assembly.

FIGS. 6A, 6B, 6C are two side views and one sectional view, taken at A—A, of the roller assembly incorporating a uni-directional rotary locking mechanism.

STRUCTURE

Figure 1:
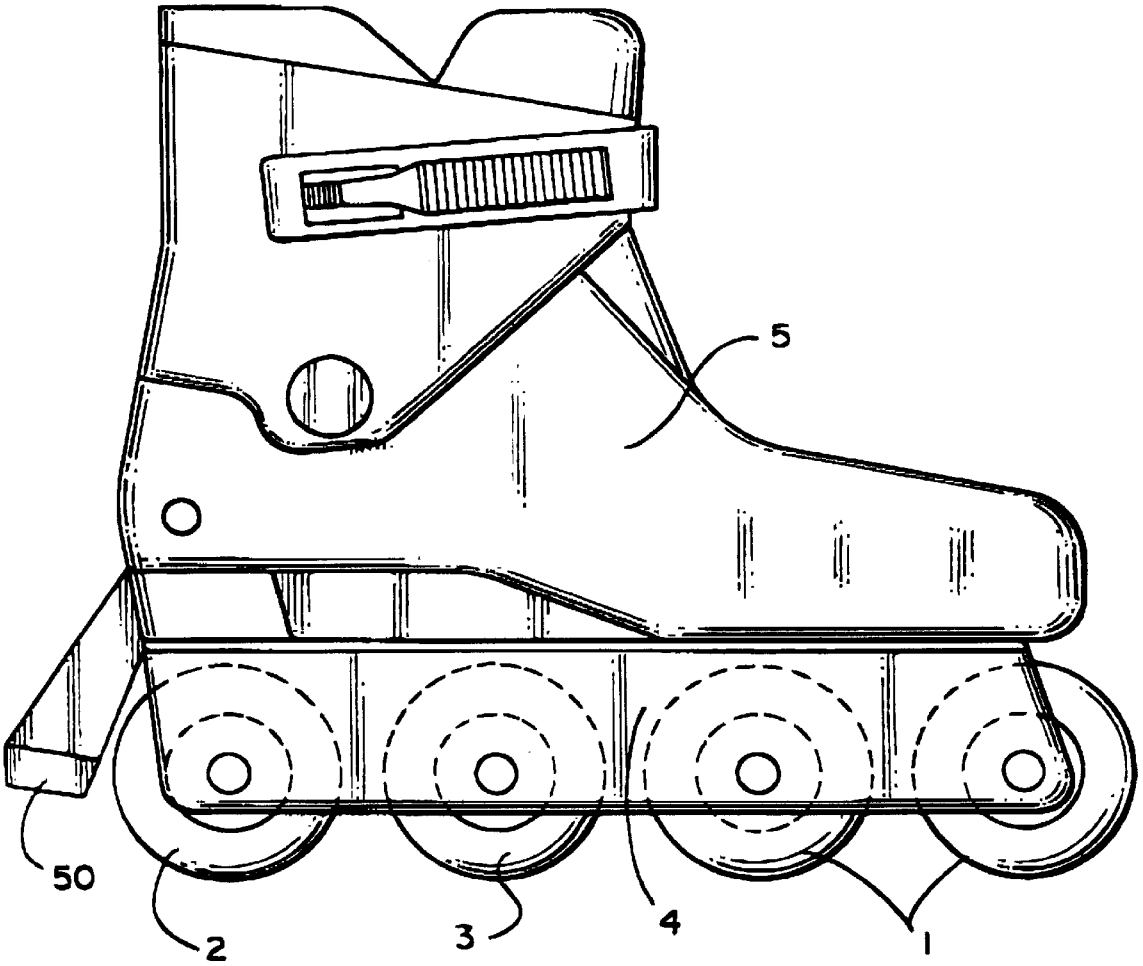
FIG. 1 is a side view of a conventional in-line skate.

Referring to FIG. 1 there is shown an in-line skate that employs U-shaped frame 4 for retaining wheels 1, 2 and 3, boot shell 5, and conventional brake pad 50.

Figure 2:
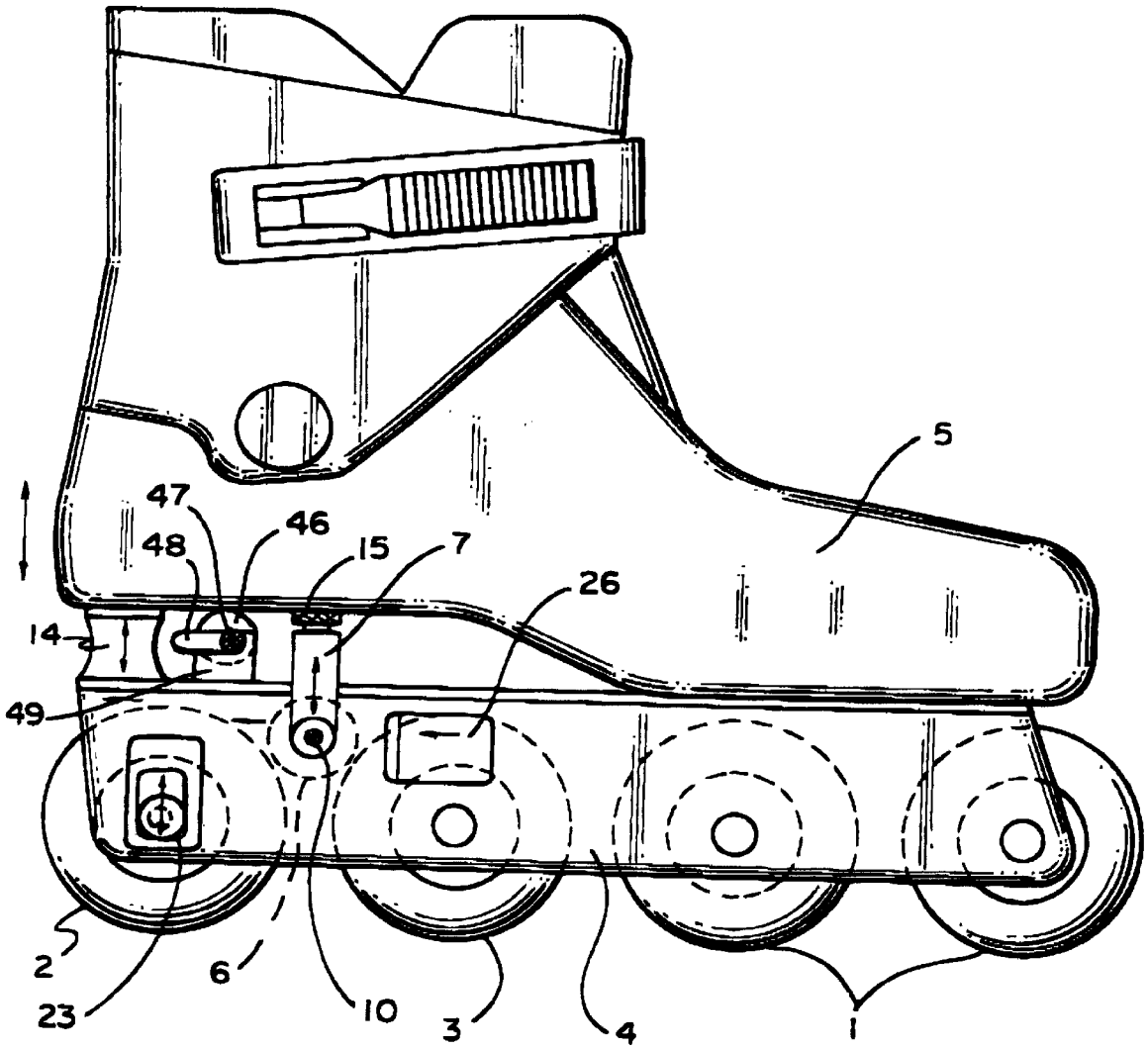
FIG. 2 is a side view of an in line skate according to the invention with the roller assembly being foot activated.

Referring to FIG. 2 there is shown an in-line skate that employs a U-shaped frame 4 for retaining wheels 1, 2, 3, boot shell 5, roller assembly 6, movable frame structure 7 to which the roller is mounted, pin 10 for retaining roller 6, threaded adjustment knob 15 for adjusting the vertical position of items 7 and 6, elastomeric support 14, elastomeric insert 23 which provides downward force for wheel 2, air inlet duct 26 which allows air to cool wheels 3 and 2 and roller assembly 6, cam 46, lever 48, lever cam pin 47 and cam support structure 49 which is fastened to frame 4.

Figure 3:
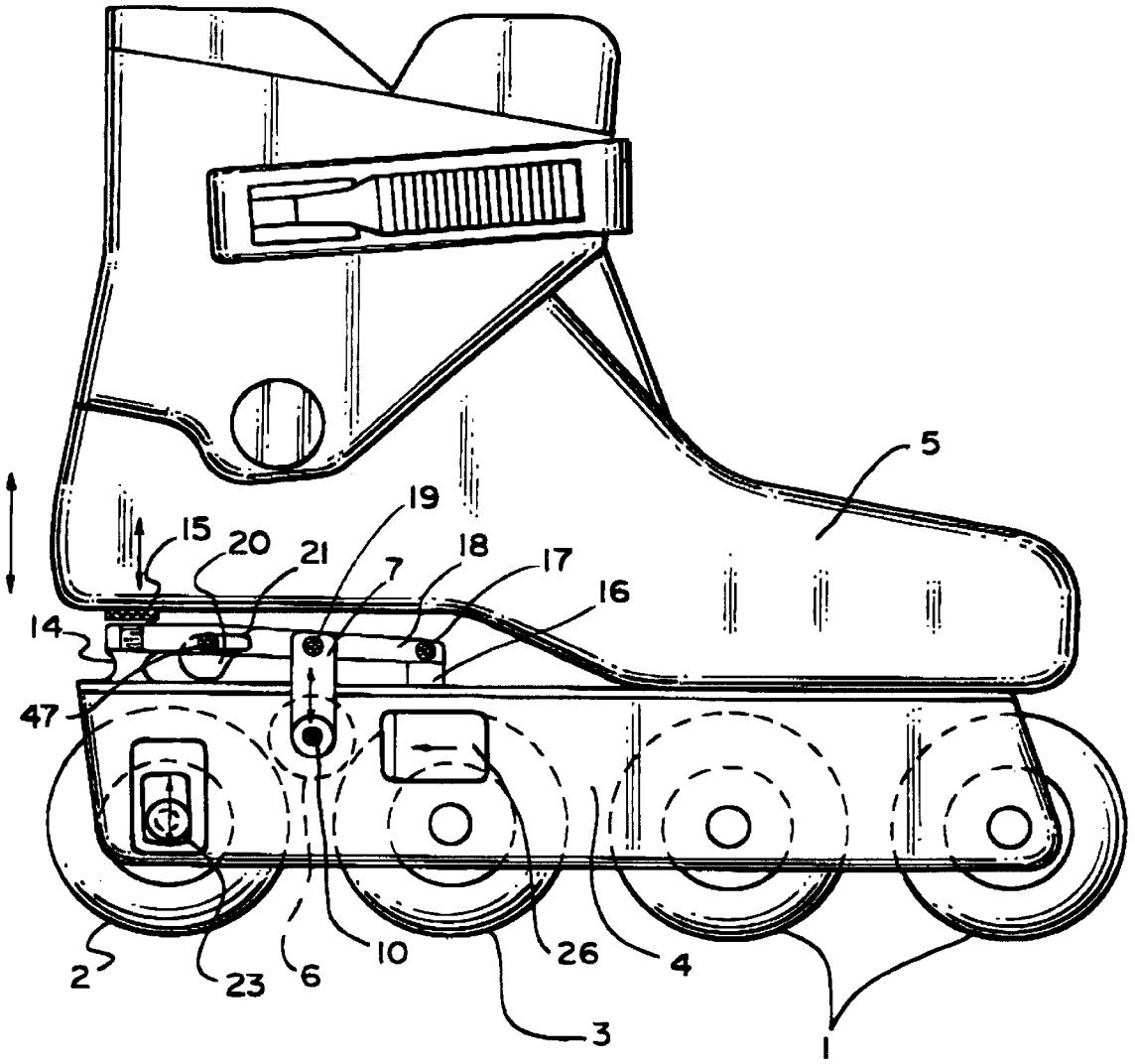
FIG. 3 is a side view of an in-line skate according to the invention and with the roller assembly being foot activated and with mechanical pressure advantage.

Referring to FIG. 3 there is shown an in-line skate that employs U-shaped frame 4 for retaining wheels 1, 2, 3, boot shell 5, roller assembly 6, the movable frame structure 7 to which the roller is mounted, pin 10 for retaining roller 6, the threaded adjustment knob 15 for adjusting the vertical position of items 7 and 6, vertically movable elastomeric support 14, elastomeric insert 23 which provides downward force for wheel 2, air inlet duct 26 which allows air to cool wheels 3 and 2 and roller assembly 6, locking cam 20 with movable arm 21, cam pin 47, retaining pin 19, leverage arm 18, pivot pin 17 and pivot retaining structure 16.

Figure 4:
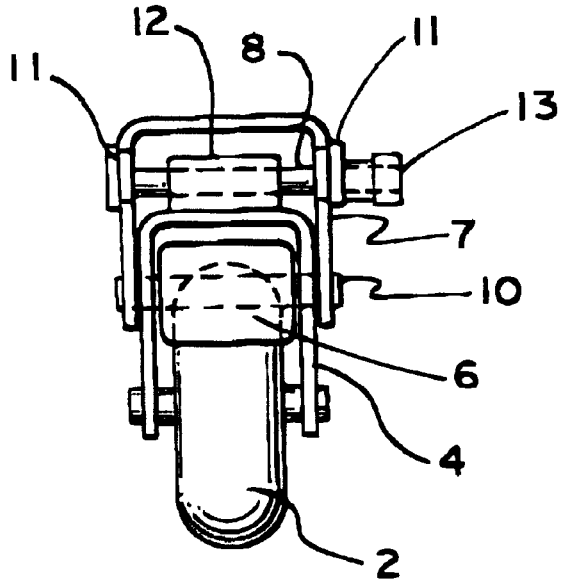
FIGS. 4 and 4A are a side view and an end view of an in-line skate according to the invention with a hand-operated cam-actuated roller assembly.
Figure 4A:
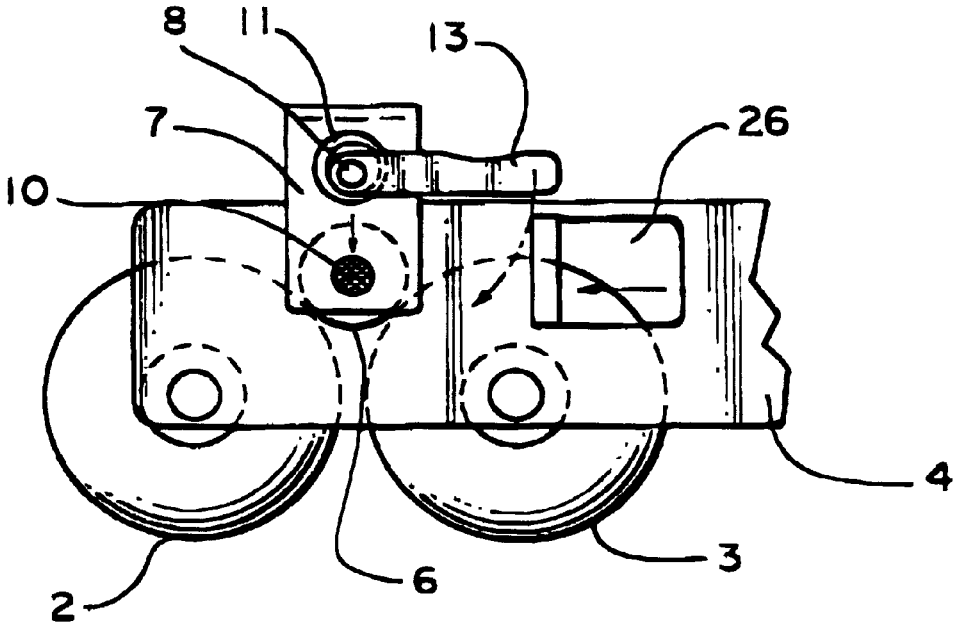

In FIG. 4 is shown the U-shaped frame 4 for retaining the wheels, wheels 2 and 3, roller assembly 6, movable frame structure 7 to which the roller is mounted, roller retaining pin 10, cam 11, movable arm 13, cam retaining pin 8, the structure 12 which holds and locates pin 8 to the U frame 4, and air duct 26.

Referring to FIG. 5 there is shown a roller ski including frame 4, which houses and retains rear wheel 2, ski boot 27, binding 28 which allows upward rear foot motion, but prevents lateral motion, support structure 30, movable arm 31 which retains the roller assembly 6, pivot pin 29, lever 34, lever pin 33, and support 32 which stops lever 34 in the horizontal position when foot force is applied.

Referring to FIGS. 6A, 6B, and 6C, it is seen that roller assembly 6A, which has unidirectional movement, includes metallic roller housing 36, roller bearings 37, needle bearing clutch 38, clutch spindle 39, and pin 10, which is permanently attached to spindle 39 and has tapped holes 40 for securing pin 10 to a movable structure.

Figure 7A:
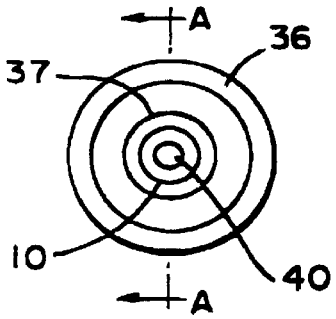
FIGS. 7A, 7B, 7C are two side views and one sectional view, taken at A—A, of the roller assembly incorporating kinematic damping.
Figure 7B:
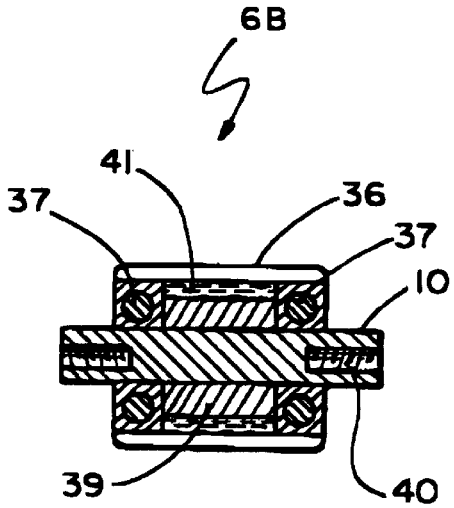
Figure 7C:
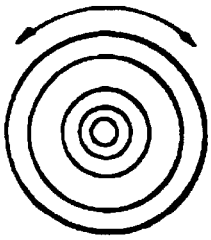

Referring to FIGS. 7A–C, roller assembly 6B, has kinematic damping as is described in U.S. Pat. No. 4,898,403, which is hereby incorporated by reference. It includes roller housing 36, the roller bearings 37, spindle 39, high viscosity kinematic damping fluid 41, and pin 10 which is attached to spindle 39 and has tapped holes 40 for securing pin 10 to a movable structure.

Figure 8A:
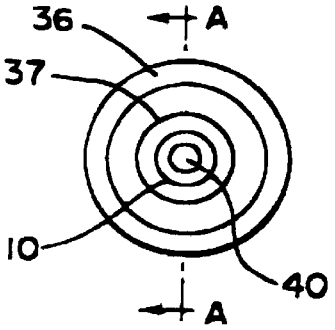
FIGS. 8A, 8B, 8C are two side views and one sectional view, taken at A—A, of the roller assembly without kinematic damping or a unidirectional rotational locking device.
Figure 8B:
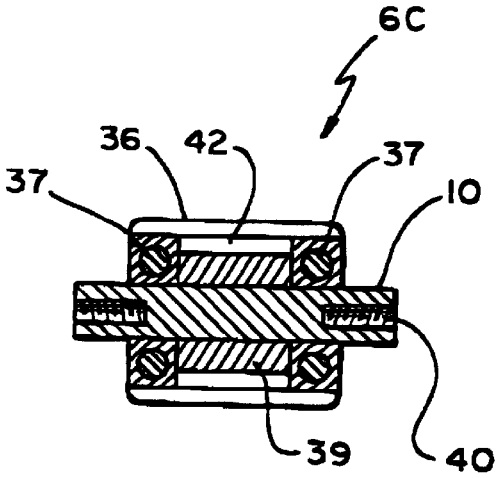
Figure 8C:
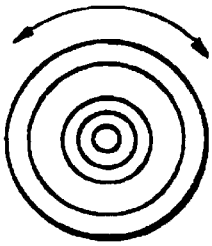

Referring to FIGS. 8A–C, roller assembly 6C includes roller housing 36, roller bearings 37, spindle 39, and pin 10 which is attached to spindle 39 and has tapped holes 40 for securing pin 10 to a movable structure. This roller does not have a unidirectional clutch or kinematic damping.

Figure 9:
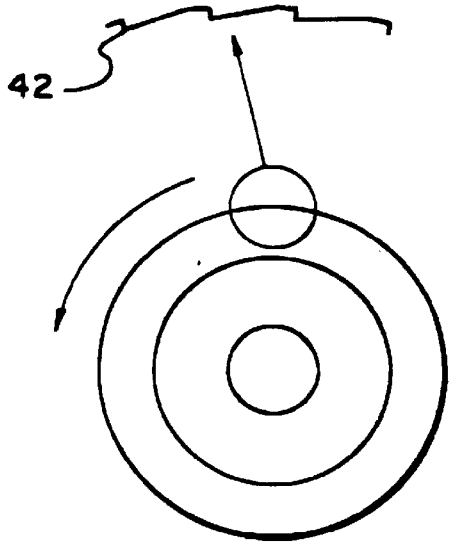
FIG. 9 is a view of the roller using a geometry with low friction in one direction and higher friction in the opposite direction.

Referring to FIG. 9 there is shown the outside roller geometry on surface 42 which increases the coefficient of friction in the locking direction when used as depicted in FIGS. 6A–C with a unidirectional clutch assembly.

Figure 10:
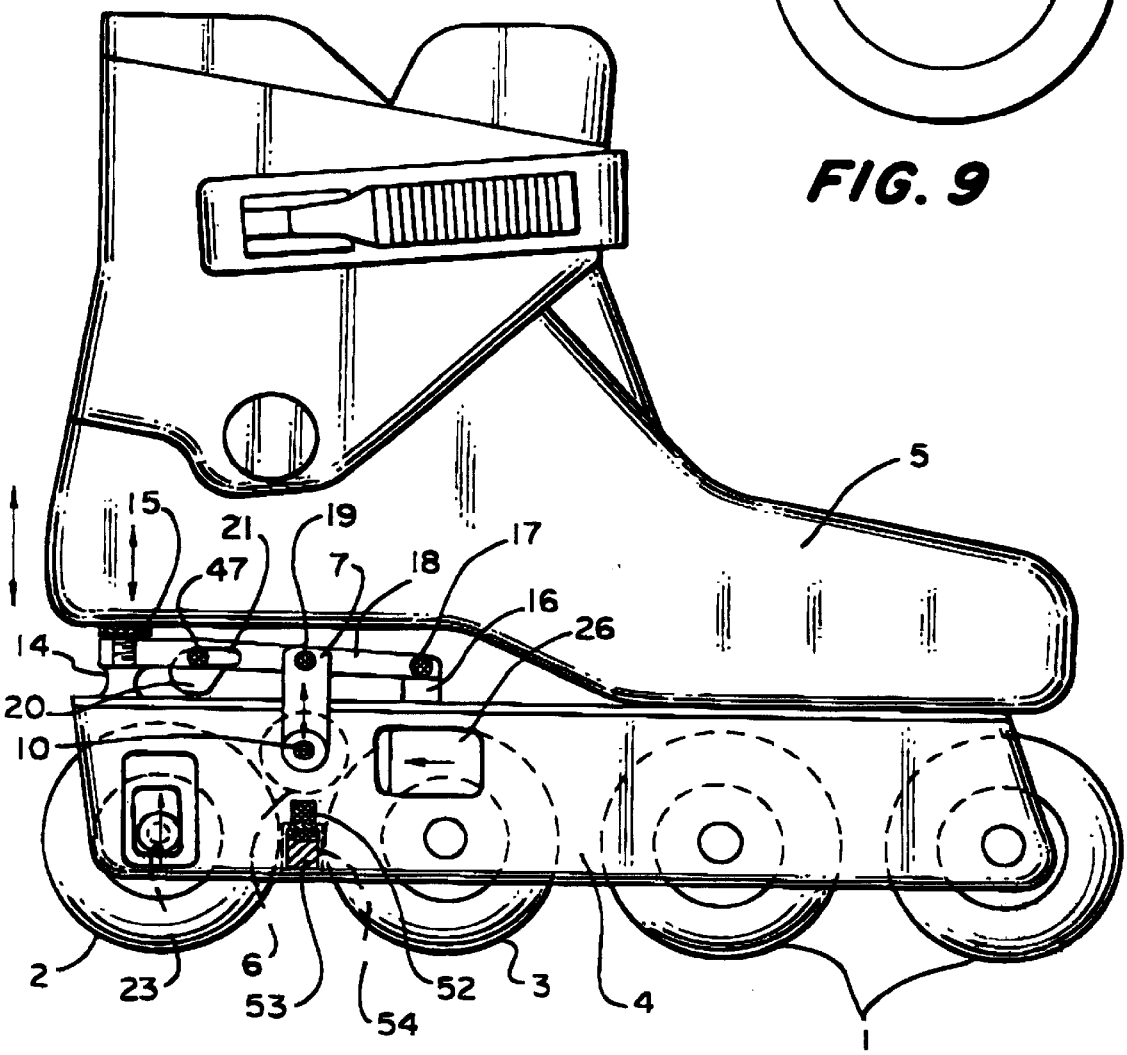
FIG. 10 is a side view of an in-line skate with the roller assembly engaging a high friction brake pad in conjunction with two wheels.

Referring to FIG. 10 there is shown an in-line skate that employs high friction pad 52 which further increases the rotational resistance of roller 6 as the roller engages pad 52. Pad 52 is biased towards roller 6 by a light force spring 53. Pad 52 and spring 53 are captured by structural housing 54. When roller 6 is used with pad device 52, the housing 36 of FIGS. 6A–C, 7A–C and 8A–C must be constructed of very hard material, harder than Rockwell 50C. The pad material is of a composition such as in automobile brake linings. In normal operation pad 52 is not in contact with roller 6. When roller 6 is pushed towards and against wheels 2 and 3, roller 6 also contacts high friction pad 52, which increases the rolling resistance of roller 6 and wheels 2 and 3.

For in-line skating the user pushes the in-line skate sideways and backwards, developing forward motion by a skating motion. When using the construction for the invention depicted in FIG. 2, the user can engage cam locking mechanism 46 in one of two positions by moving lever 48. Lever 48 can be in the position shown in FIG. 2, with the in-line skate becoming basically a conventional in-line skate, preventing roller assembly 6 from contacting wheels 2 and 3. Lever 48 can be rotated from the position shown in FIG. 2, with the cam locking mechanism positioned so that the rear of the skate boot shell can be forced downward, forcing roller assembly 6 against wheels 2 or 3 with variable force, dependent on the position of the cam lockout member, the weight of the person and the amount of rearward weight bias.

When using the roller assembly shown in FIGS. 6A–C, which rotates freely in only one direction, it is now possible to push backwards without a side skate motion to develop forward motion as the wheels do not roll as freely in the backward direction. This is of particular benefit for novice skaters. When approaching a downhill grade the user can place the cam locking mechanism 46 by moving lever 48 in such a position that the roller assembly 6 is forced by the weight of the body into wheels 2 and 3 with sufficient force to regulate speed or to stop. When weight is distributed over the ball of the foot, there is no braking action. As weight is shifted towards the heel, there is pressure on the roller which produces greater rolling resistance. Thus one shifts weight forward to have the skates roll freely, and shifts weight backwards to have the skates slow down. If a uni-directional locking mechanism is not required by the user the roller assembly can be configured as shown in FIGS. 8A–C or with kinematic damping as shown in FIGS. 7A–C. For maximum braking effect the roller assembly of FIGS. 6A–C, 7A–C and 8A–C can be used with the frictional rotary braking pad assist system of FIG. 10. When used with the frictional brake assist system shown in FIG. 10, roller housing 36 of FIGS. 6A–C, 7A–C and 8A–C must be of a very hard material, harder than Rockwell 50C.

FIG. 3 shows a similar foot actuated roller assembly, but here a mechanical advantage leverage system 18, has been incorporated so that for equivalent foot pressure roller assembly 6 has greater force against wheels 2 and 3. In operation the system works similar to that shown in FIG. 2 and incorporates a similar cam locking mechanism 20 with lever 21.

FIG. 4 shows a roller assembly 6 which is hand actuated by moving a lever 13 attached to cam 11 in such fashion that the roller applies variable force to wheels 2 and 3. Cam 11 is lockable in various force positions. When a beginner skater wants to reduce rearward motion during push off, the uni-directional rotary assembly shown in FIG. 6 can be employed which permits minimal forward resistance when the roller assembly is lightly forced against wheels 2 and 3, but substantively increases rearward rolling resistance as the roller 6 cannot roll in the backward direction forcing the wheels 2 and 3 to be frictionally forced about the roller. When the roller is made of a high coefficient of friction material or with a geometry such as or similar to that shown in FIG. 9, forward resistance is minimal and rearward resistance is high. When used for speed reduction only, such as navigating a downhill, cam 11 is rotated so as to forcibly push roller 6 into wheels 2 and 3 increasing rolling resistance. When used in this manner, roller assemblies as shown in FIGS. 7A–C and 8A–C can be used in place of a uni-directional roller as shown in FIGS. 6A–C.

FIG. 5 shows a roller ski with a foot actuated braking device and uni-directional clutch assembly. This system works similar to the in-line skate where when speed reduction or a uni-directional clutch is desired, lever 34 is rotated downward in such fashion that when the heel of the ski boot pushes the lever 34, the roller assembly 6 is forced against the wheel 2. The amount of force of roller 6 against wheel 2 can be regulated by the amount of force applied by the heel. To reduce braking effort one applies more body weight to the ball of the foot and less to the heel portion. If the roller ski is used as a skating ski, where a uni-directional locking mechanism is not required, the most effective braking method would be to use the kinematic dampened roller assembly shown in FIG. 7 or the frictional brake assist system shown in FIG. 10. As the skier comes to a downhill, he or she can move lever 34 from the vertical to the horizontal position and then control speed by varying heel pressure.

Other embodiments of the invention are within the scope of the following claims. For example, other materials and dimensions can be used. Different methods of applying pressure could be used in lieu of the devices shown. The roller assembly can be moved against the wheels by conventional mechanical, hydraulic, electro mechanical, pneumatic, hydro-mechanical methods or, combinations of these mechanisms.

What is claimed is:

1. A foot supporting rolling device comprising a foot supporting structure for supporting a foot of a user, first and second wheels rotatably mounted on said foot supporting structure, said first and second wheels being made of an elastomeric material of a first hardness, a roller mounted in such fashion that it can be forced by the user against both said first and second wheels so as to simultaneously provide resistance to the rotation of said first and second wheels, and an actuator permitting the user to move said roller during skating so as to apply a braking force or to remove a braking force.

2. A foot supporting rolling device comprising a foot supporting structure for supporting a foot of a user, first and second wheels rotatably mounted on said foot supporting structure, said first and second wheels being made of an elastomeric material of a first hardness, and a roller mounted in such fashion that it can be forced against said first wheel so as to provide resistance to the rotation of said first wheel, said first wheel being movably biased toward the rolling surface in such a fashion as to follow the contour of the rolling surface while said roller provides said resistance.

3. The rolling device of claim 1 or 2 wherein said roller is made of a material that has hardness greater than said first hardness.

4. The rolling device of claim 3 where said roller is of a diameter smaller than diameters of said first and second wheels.

5. The rolling device of claim 1 further comprising a first movable member that is mounted to said foot supporting structure and carries said roller thereon, said first movable member being movable toward and away from said first and second wheels.

6. The rolling device of claim 5 wherein said first movable member is movable to a neutral position in which said roller does not contact said first and second wheels.

7. A foot supporting rolling device comprising a foot supporting structure for supporting a foot of a user, first and second wheels rotatably mounted on said foot supporting structure, said first and second wheels being made of an elastomeric material of a first hardness, and a roller mounted in such fashion that it can be forced by the user against both said first and second wheels so as to a simultaneously provide resistance to the rotation of said first and second wheels, further comprising a first movable member that is mounted to said foot supporting structure and carries said roller thereon, said first movable member being movable toward and away from said first and second wheels, wherein said first movable member has a plurality of different maximum braking positions in which said roller is prevented from further movement toward said first and second wheels, the axis of said roller being at different distances from the axes of said first and second wheels in said different maximum braking positions, said different maximum braking positions providing different wheel rolling resistances.

8. The rolling device of claim 7 wherein said first movable member is lockable into said different speed reducing positions.

9. A foot supporting rolling device comprising a foot supporting structure for supporting a foot of a user, first and second wheels rotatably mounted on said foot supporting structure, said first and second wheels being made of an elastomeric material of a first hardness, a roller mounted in such fashion that it can be forced by the user against both said first and second wheels so as to provide resistance to the rotation of said first and second wheels, and a first movable member that is mounted to said foot supporting structure and carries said roller thereon, said first movable member being movable toward and away from said first and second wheels, wherein said first movable member has a plurality of different speed reducing positions in which said roller contacts said first and second wheels, the axis of said roller being at different distances from the axes of said first and second wheels in said different speed reducing positions, said different speed reducing positions providing different wheel rolling resistances, wherein said first movable member is lockable into said different speed reducing positions, wherein said first movable member is movably mounted on said foot supporting structure, and further comprising a second movable member that applies force to said first movable member and locks said first movable member in said different positions.

10. The rolling device of claim 9 in which said second movable member has a movable arm and produces a force against said first movable member with a mechanical advantage.

11. The rolling device of claim 1, 2, 5 or 7 in which the roller is kinematically dampened so as to produce higher rolling resistance with increased speed.

12. The rolling device of claim 1, 2, 5, or 7 in which the roller contains a uni-directional locking mechanism which allows the roller to rotate in only one direction.

13. A foot supporting rolling device comprising a foot supporting structure for supporting a foot of a user, said structure including a boot with a heel portion, first and second wheels rotatably mounted on said foot supporting structure, said first and second wheels being made of an elastomeric material of a first hardness, and said heel portion being movable with respect to said wheels, a roller mounted on a first movable member in such fashion that it can be forced by the user against said first wheel so as to provide resistance to the rotation of said first wheel, in which said first movable member is actuated by foot pressure applied to said heel portion of said foot supporting structure.

14. A foot supporting rolling device comprising a foot supporting structure for supporting a foot of a user, said structure including a boot with a heel portion, first and second wheels rotatably mounted on said foot supporting structure, said first and second wheels being made of an elastomeric material of a first hardness, and said heel portion being movable with respect to said wheels, a roller mounted on a first movable member in such fashion that it can be forced by the user against said first wheel so as to provide resistance to the rotation of said first wheel, in which said first movable member is actuated by foot pressure applied to said heel portion of said foot supporting structure, in which said roller contains a combination unidirectional locking mechanism and kinematic damping.

15. The rolling device of claim 13 in which said first movable member is biased away from said first wheel in such fashion that said roller does not contact said first and second wheels unless foot pressure is applied to said first movable member.

16. A foot supporting rolling device comprising a foot supporting structure for supporting a foot of a user, first and second wheels rotatably mounted on said foot supporting structure, said first and second wheels being made of an elastomeric material of a first hardness, and a roller mounted in such fashion that it can be forced by the user against both said first and second wheels so as to provide resistance to the rotation of said first and second wheels, and a first movable member that is mounted to said foot supporting structure and carries said roller thereon, said first movable member being movable toward and away from said first and second wheels, wherein said first movable member is actuated by foot pressure applied to said foot supporting structure, further comprising a movable camming member that can be moved to a position in which said first movable member is prevented from moving so as to permit said roller to contact said first and second wheels.

17. The rolling device of claim 16 in which the movable camming member can be moved to a position in which said first movable member can be forced against said first and second wheels.

18. A foot supporting rolling device comprising a foot supporting structure for supporting a foot of a user, said structure including a boot with a heel portion, first and second wheels rotatably mounted on said foot supporting structure, said first and second wheels being made of an elastomeric material of a first hardness, and said heel portion being movable with respect to said wheels, a roller mounted on a first movable member in such fashion that it can be forced by the user against said first wheel so as to provide resistance to the rotation of said first wheel, in which said first movable member is actuated by foot pressure applied to said heel portion of said foot supporting structure, in which said roller is kinematically dampened so as to produce, with the same force against said first and second wheels, higher rolling resistance of said first and second wheels.

19. A foot supporting rolling device comprising a foot supporting structure for supporting a foot of a user, said structure including a boot with a heel portion, first and second wheels rotatably mounted on said foot supporting structure, said first and second wheels being made of an elastomeric material of a first hardness, and said heel portion being movable with respect to said wheels, a roller mounted on a first movable member in such fashion that it can be forced by the user against said first wheel so as to provide resistance to the rotation of said first wheel, in which said first movable member is actuated by foot pressure applied to said heel portion of said foot supporting structure, in which said roller contains a uni-directional locking mechanism which allows said roller to rotate in only one direction.

20. The rolling device of claim 14, 18, or 19 wherein said foot supporting structure includes a frame to which said first and second wheels are mounted and a flexible sole connected to said frame so that when body weight is shifted toward the rear of the sole, said first movable member moves toward said first wheel, and said roller is forced against said first wheel.

21. The rolling device of claim 1, 2, 5, or 7, in which said roller is made of a material that has a hardness greater than said first hardness and is made of a material with a high coefficient of friction.

22. The rolling device of claim 1, 2, 5, or 7, wherein the roller is made of a material that has a hardness greater than said first hardness and has a geometry that favors forward rolling motion and hinders rearward motion.

23. The rolling device of claim 1, 5, or 7, further comprising a high friction brake pad mounted for contact by said roller when said roller continues to move beyond initial contact with said first and second wheels.

24. The rolling device of claim 2 wherein said roller is made of a material harder than Rockwell 50C.

25. The rolling device of claim 1, 2, 5, or 7, further comprising vent structure that directs air to cool the roller.

26. The rolling device of claim 2 wherein said rolling device is an in-line roller skate.

27. The rolling device of claim 17 in which said roller is kinematically dampened so as to produce, with the same force against said first and second wheels, higher rolling resistance of said first and second wheels.

28. The rolling device of claim 17 in which said roller contains a uni-directional locking mechanism which allows said roller to rotate in only one direction.

29. The rolling device of claim 17 in which said roller contains a combination unidirectional locking mechanism and kinematic damping.

30. The rolling device of claim 1 or 13 wherein said rolling device is an in-line roller skate.

31. The rolling device of claim 1 wherein said roller is made of a material harder than Rockwell 50C.

32. The rolling device of claim 1 wherein said roller is made of a material that has hardness greater than said first hardness.

33. The rolling device of claim 32 where said roller is of a diameter smaller than diameters of said first and second wheels.

* * * * *